US008588372B2

(12) United States Patent
Zou et al.

(10) Patent No.: US 8,588,372 B2
(45) Date of Patent: Nov. 19, 2013

(54) APPARATUS FOR MODIFYING ELECTRON BEAM ASPECT RATIO FOR X-RAY GENERATION

(75) Inventors: Yun Zou, Clifton Park, NY (US); Peter Andras Zavodszky, Clifton Park, NY (US); Mark E. Vermilyea, Niskayuna, NY (US); Sergio Lemaitre, Whitefish Bay, WI (US); Mark Alan Frontera, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 506 days.

(21) Appl. No.: 12/639,419

(22) Filed: Dec. 16, 2009

(65) Prior Publication Data

US 2011/0142204 A1 Jun. 16, 2011

(51) Int. Cl.
*H05G 1/52* (2006.01)

(52) U.S. Cl.
USPC ..... 378/113; 378/122; 378/136; 378/138

(58) Field of Classification Search
USPC ..... 378/113, 121, 122, 136–138
See application file for complete search history.

(56) References Cited

U.S. PATENT DOCUMENTS

| | | | | |
|---|---|---|---|---|
| 4,032,815 | A | 6/1977 | Haflinger | |
| 4,521,901 | A | 6/1985 | Rand | |
| 4,698,835 | A * | 10/1987 | Ono et al. | 378/136 |
| 4,730,353 | A * | 3/1988 | Ono et al. | 378/138 |
| 5,812,632 | A * | 9/1998 | Schardt et al. | 378/137 |
| 6,404,149 | B1 | 6/2002 | Ueno et al. | |
| 6,438,207 | B1 * | 8/2002 | Chidester et al. | 378/138 |
| 6,553,096 | B1 | 4/2003 | Zhou et al. | |
| 6,570,320 | B1 | 5/2003 | Burkhardt et al. | |
| 6,876,724 | B2 | 4/2005 | Zhou et al. | |
| 2001/0015610 | A1 | 8/2001 | Park | |
| 2001/0038263 | A1 * | 11/2001 | Lee et al. | 313/542 |
| 2002/0047670 | A1 | 4/2002 | Ono | |
| 2003/0099327 | A1 * | 5/2003 | Matsushita et al. | 378/138 |
| 2005/0175151 | A1 | 8/2005 | Dunham et al. | |
| 2006/0274889 | A1 | 12/2006 | Lu et al. | |
| 2007/0237300 | A1 | 10/2007 | Kim et al. | |
| 2008/0043920 | A1 * | 2/2008 | Liu et al. | 378/138 |
| 2011/0142204 | A1 * | 6/2011 | Zou et al. | 378/138 |

OTHER PUBLICATIONS

Liu et al., "Development of a carbon nanotube based microfocus x-ray tube with single focusing electrode," Review of Scientific Instruments 77, 054302, American Institute of Physics, pp. 1-6, 2006, http://rsi.aip.org/rsi/copyright.jsp.

(Continued)

*Primary Examiner* — Thomas R Artman
(74) *Attorney, Agent, or Firm* — Ziolkowski Patent Solutions Group, SC

(57) ABSTRACT

An apparatus for modifying an aspect ratio of an electron beam to form a focal spot having a desired size and aspect ratio on a target anode is disclosed. The apparatus includes an emitter element configured to generate an electron beam having a first aspect ratio shape and an extraction electrode positioned adjacent to the emitter element to extract the electron beam out therefrom, the extraction electrode including an opening therethrough. The apparatus also includes at least one shaping electrode positioned to receive the electron beam after passing through the extraction electrode, the shaping electrode defining a non-circular aperture therein and being configured to provide at least one of shaping and focusing of the electron beam to have a second aspect ratio shape different from the first aspect ratio shape so as to form a focal spot having a desired size and aspect ratio on a target anode.

20 Claims, 8 Drawing Sheets

(56) References Cited

OTHER PUBLICATIONS

Lalush et al., "Tomosynthesis Reconstruction From Multi-Beam X-Ray Sources," IEEE, pp. 1180-1183, 2006.

Zou et al., "Theoretical study of transverse emittance growth in a gridded electron gun," Nuclear Instruments and Methods In Physics Research A 519, pp. 432-441, 2004.

Scheitrum, "Design and Construction of a W-band Sheet Beam Klystron," Contributed to 7th Workshop on High Energy Density and High Power RF, Jun. 13-17, 2005, Kalamata, Greece.

Burke et al., "W-band Sheet Beam Klystron Gun Design Using MICHELLE," IEEE, pp. 43-44, 2006.

* cited by examiner

APPARATUS FOR MODIFYING ELECTRON BEAM ASPECT RATIO FOR X-RAY GENERATION

BACKGROUND OF THE INVENTION

The present invention relates generally to electron emitters, and, more particularly, to an apparatus for modifying an aspect ratio of an electron beam to form a focal spot having a desired size and aspect ratio on a target anode.

In an x-ray imaging system, formation of a small focal spot on a target anode is desired to achieve high-quality x-ray imaging. In order to maximize the target thermal management and cathode emission capability, an x-ray tube is configured such that a non-circular (i.e., linear) focal spot is formed on the target. In the imaging system, the detector will view the x-ray spot at a shallow angle (7-12 degree) to achieve an effective small optical spot size.

To achieve a linear focal spot, today's x-ray tubes use a linear electron emitter element or cathode that has almost the same aspect ratio as the desired focal spot, and a focusing cup/electrode is used to focus the electron beam onto the target anode. The drawback of using such large aspect ratio cathodes is its difficulty of beam optics design. That is, with the generation of an electron beam with a large aspect ratio (by a similarly shaped cathode), it is very difficult to design good beam optics, which are required to achieve a small focal spot on the target.

Additionally, with specific reference to x-ray tubes that implement a thermionic cathode, the large aspect ratio of the cathode imposes additional problems. That is, in order for the thermionic cathode to have a uniform emission, the temperature on the cathode surface has to be uniform. In an x-ray tube environment, a temperature of the cathode surface can be as high as 2600 degrees Celsius, while the surrounding area is at room temperature. For a large aspect ratio thermionic cathode, there is a larger edge area, which results in a temperature of the cathode that tends to be less uniform than a circular cathode.

While the use of linear emitter elements that generate linear electron beams has various drawbacks as set forth above, circular emitter elements that generate circular electron beams can mitigate some of these problems. That is, the use of a circular electron beam allows for the simpler design of beam optics that will generate a small focal spot. Additionally, for emitter elements that are in the form of a thermionic cathode, a circular emitter element profile promotes a stable and consistent temperature thereacross, so as to provide for a more uniform emission of electrons.

Thus, a need exists for an apparatus that provides for the generation of a circular electron beam, so as to allow for the simpler design of beam optics for focusing the electron beam, while still providing for formation of a small, linear focal spot on a target anode.

BRIEF DESCRIPTION OF THE INVENTION

Embodiments of the invention overcome the aforementioned drawbacks by providing an apparatus that provides for modifying an aspect ratio of an electron beam to form a focal spot having a desired size and aspect ratio on a target anode.

According to one aspect of the invention, an electron generator unit includes an emitter element configured to generate an electron beam having a first aspect ratio shape and an extraction electrode positioned adjacent to the emitter element to extract the electron beam out therefrom, the extraction electrode including an opening therethrough. The electron generator unit also includes at least one shaping electrode positioned to receive the electron beam after passing through the extraction electrode, the shaping electrode defining a non-circular aperture therein and being configured to provide at least one of shaping and focusing of the electron beam to have a second aspect ratio shape different from the first aspect ratio shape so as to form a focal spot having a desired size and aspect ratio on a target anode.

According to another aspect of the invention, an x-ray tube includes a housing enclosing a vacuum chamber and an electron generator unit positioned within the housing, with the electron generator unit further including an emitter element configured to generate an electron beam having a first aspect ratio, an extraction electrode having an opening therethrough that is positioned adjacent to the emitter element to extract the electron beam out therefrom, and at least one shaping electrode positioned to receive the electron beam after passing through the extraction electrode, with the shaping electrode defining a non-circular opening therein and being configured to shape the electron beam to have a second aspect ratio different from the first aspect ratio. The x-ray tube also includes a target anode positioned in a path of the shaped electron beam and configured to emit high-frequency electromagnetic energy when the shaped electron beam impinges thereon.

According to yet another aspect of the invention, an x-ray tube includes a circular emitter element configured to generate an electron beam having a circular cross-section and a shaping electrode positioned to receive the electron beam from the circular emitter element and having a non-circular aperture formed therethrough, the non-circular aperture of the shaping electrode configured to focus and shape the electron beam as it passes through the shaping electrode such that a shape of the electron beam is modified to have a non-circular cross-section. The x-ray tube also includes a target anode positioned in a path of the non-circular electron beam that is configured to emit high-frequency electromagnetic energy when the non-circular electron beam impinges thereon.

These and other advantages and features will be more readily understood from the following detailed description of preferred embodiments of the invention that is provided in connection with the accompanying drawings.

BRIEF DESCRIPTION OF THE DRAWINGS

The drawings illustrate embodiments presently contemplated for carrying out the invention.

In the drawings.

DETAILED DESCRIPTION OF THE INVENTION

The operating environment of embodiments of the invention is described with respect to an electron generator unit and x-ray source that includes a field emitter based cathode. That is, the electron beam emission and electron beam focusing and reshaping schemes of the invention are described as being provided for an electron generator unit and field emitter based x-ray source. However, it will be appreciated by those skilled in the art that embodiments of the invention for such electron beam emission and electron beam focusing and reshaping schemes are equally applicable for use with other cathode technologies, such as dispenser cathodes and other thermionic cathodes. The invention will be described with respect to a field emitter unit, but is equally applicable with other cold cathode and/or thermionic cathode structures.

Figure 1:
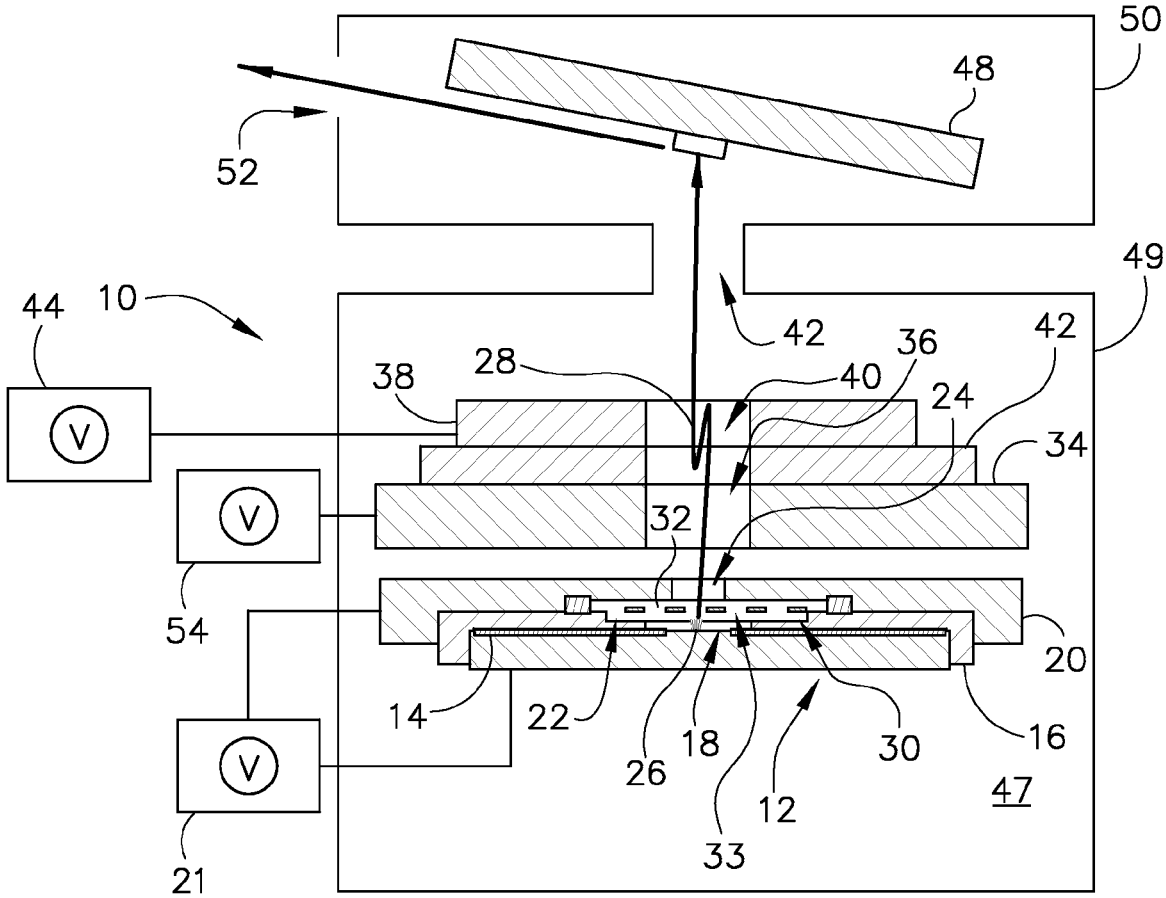
FIG. 1 is a cross-sectional view of an electron emitter unit and target anode in accordance with an embodiment of the present invention.

Referring to FIG. 1, a cross-sectional view of an electron generator unit 10 (i.e., cathode assembly) is depicted according to one embodiment of the invention. As will be explained in greater detail below, in one embodiment, electron generator unit 10 is a cold cathode, carbon nanotube (CNT) field emitter unit. However, it is understood that the features and adaptations described herein are also applicable to other types of field emitters, such as Spindt-type emitters, or other thermionic cathode or dispenser cathode type electron generators. As shown in FIG. 1, electron generator unit 10 includes a substrate layer 12 that is preferably formed of a conductive or semiconductive material such as a doped silicon-based substance or of copper or stainless steel. Therefore, substrate layer 12 is preferably rigid. A dielectric film 14 is formed or deposited over substrate 12 to separate an insulating layer 16 (i.e., ceramic spacer) therefrom. Dielectric film 14 is preferably formed of a non-conductive substance or a substance of a very high electrical resistance, such as silicon dioxide ($SiO_2$) or silicon nitride ($Si_3N_4$), or some other material having similar dielectric properties. A channel or aperture 18 is formed in dielectric film 14 by any of several known chemical or etching manufacturing processes.

As shown in FIG. 1, substrate layer 12 is registered onto insulating layer 16, which in one embodiment is a ceramic spacer element having desired insulating properties as well as compressive properties for absorbing loads caused by translation of the field emitter unit (e.g., when the field emitter unit forms part of an x-ray source that rotates about a CT gantry). Insulating layer 16 is used to separate the substrate layer 12 from an extraction electrode 20 (i.e., gate electrode, gate layer), so that an electrical potential may be applied between extraction electrode 20 and substrate 12 by way of a voltage supplied by controller 21. A channel or cavity 22 is formed in insulating layer 16, and a corresponding opening 24 is formed in extraction electrode 20. As shown, opening 24 substantially overlaps cavity 22. In other embodiments, cavity 22 and opening 24 may be of approximately the same diameter, or cavity 22 may be narrower than opening 24 of extraction electrode 20.

An electron emitter element 26 (i.e., cathode element) is disposed in cavity 22 and affixed on substrate layer 12. The interaction of an electrical field in opening 22 (created by extraction electrode 20) with the emitter element 26 generates an electron beam 28 that may be used for a variety of functions when a control voltage is applied to emitter element 26 by way of substrate 12. In one embodiment, emitter element 26 is a carbon nanotube-based emitter; however, it is contemplated that the emitter element may be in the form of a dispenser cathode or other thermionic cathode.

Figure 2:
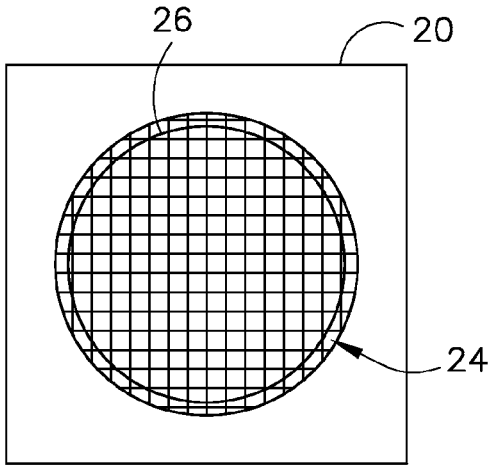
FIG. 2 is a top plan view of an emitter element and extraction electron for use in the electron emitter unit of FIG. 1 in accordance with an embodiment of the present invention.

As shown in FIG. 2, according to one embodiment of the invention, emitter element 26 is constructed as a circular emitter element (i.e., having a circular cross-section) configured to generate/emit an electron beam or stream of electrons having a circular cross-section or profile (i.e., a first/original beam profile). Similarly, opening 24 of extraction electrode 20 is formed as a circular opening comparable in size to emitter element 26. Construction of emitter element 26 as a circular element provides for a number of benefits with respect to beam emission and beam focusing. For example, the beam optics design of electron beams having a circular cross-section provides for efficient formation of a small focal spot on a target anode by electron generator unit 10. Additionally, for embodiments of the invention where emitter element 26 comprises a thermionic cathode, the circular shape of the emitter element allows for increased uniformity in temperature of the element. That is, it is recognized that in order for the thermionic cathode to have a uniform emission, the temperature on the cathode surface has to be uniform. In an x-ray tube environment, the cathode surface would be as high as 2600 degrees Celsius, while the surrounding area is at room temperature. For a thermionic cathode having a large aspect ratio, there is larger edge area and temperature tends to be less uniform than a circular cathode. Thus, construction of emitter element 26 as a circular element provides for greater control of beam optics and temperature control Referring again to FIG. 1, according to an exemplary embodiment of the invention where emitter element 26 is formed as a field emitter element, a meshed grid 32 is positioned between cavity 22 of insulating layer 16 and opening 24 of extraction electrode 20 to reduce the voltage needed to extract electron beam 28 from emitter element 26. This positions meshed grid 32 in proximity to emitter element 26 to reduce the voltage needed to extract electron beam 28 from emitter element 26. That is, for efficient extraction, a gap between meshed grid 32 and emitter element 26 is kept within a desired distance (e.g., 0.1 mm to 2 mm) in order to enhance the electric field around emitter element 26 and minimize the total extracting voltage supplied by a controller 21 that is necessary to extract electron beam 28. Placement of meshed grid 32 over cavity 22 allows for an extraction voltage applied to extraction electrode 20 in the range of approximately 1-3 kV, depending on the distance between meshed grid 32 and emitter element 26. By reducing the total extracting voltage to such a range, high voltage stability of electron generator unit 10 is improved, and higher emission current in electron beam 28 is made possible. The difference in potential between emitter element 26 and extraction electrode 20 is minimized to reduce high voltage instability in emitter unit 10 and simplify the need for complicated driver/control design therein.

As further shown in FIG. 1, an emittance compensation electrode (ECE) 34 is also included in electron generator unit 10 and is positioned adjacent to meshed grid 32 on an opposite side from emitter element 26 so as to receive electron beam 28 upon exiting the extraction electrode 20. The ECE 34 is positioned adjacent to meshed grid 32 and functions to minimize beam emittance growth in electron beam 28 caused by the passing of the beam through the meshed grid 32. That is, the extent of space and momentum phase space (i.e., emittance) occupied by the electrons of electron beam 28 is controlled and minimized by ECE 34. The ECE 34 includes an aperture 36 formed therein through which electron beam 28 passes. An electrostatic field is generated across aperture 36 by application of a voltage (i.e., a compression voltage) to ECE 34 by way of a controller 54. The electrostatic field interacts with electron beam 28 such that electrons in electron beam 28 are confined to a small distance in a transverse direction and have nearly the same momentum (i.e., "compressing" electron beam 28). Such spatial confinement and uniformity in momentum of the electrons reduces emittance growth in electron beam 28. The voltage applied to ECE 34 by controller 21 typically ranges from about 4 kV to 20 kV, although it is envisioned that lesser or greater voltages can also be applied. Furthermore, the voltage applied to ECE 34 can be either a constant voltage or can be varied. That is, in one embodiment, a voltage applied to ECE 34 corresponds to an extraction voltage applied to extraction electrode 20 and meshed grid 32 (and to substrate 12) for extracting electron beam 28 from emitter element 26. Thus, the voltage applied to ECE 34 can be of an amount such that the electric fields present at both sides of meshed grid 32 are equal to one another, allowing for optimized control of emittance growth in electron beam 28.

ECE 34 also functions to allow for increased beam current modulation of electron beam 28 in electron generator unit 10. That is, ECE 34 allows for current density in electron beam 28 to be increased to higher levels without suffering an associated degradation in beam quality. When an extraction voltage applied to meshed grid 32 by controller 21 is changed to modulate electron beam current, the compression voltage applied to ECE 34 can also be changed so as to minimize emittance growth in electron beam 28. That is, when the current density in electron beam 28 is increased by way of an increased extraction voltage being applied to extraction electrode 20 and meshed grid 32 by controller 21, the compression voltage applied to ECE 34 is also increased so as to allow for greater compression of electron beam 28 and to minimize emittance growth therein. By associating the voltage supplied to extraction electrode 20 and meshed grid 32 with the voltage supplied to ECE 34, beam quality can always be preserved at different beam current densities. It is also envisioned, however, that rather than varying a voltage applied to ECE 34, it is also possible that the voltage applied to ECE 34 be fixed relative to the varied voltage applied to extraction electrode 20 and meshed grid 32. Applying such a fixed voltage to ECE 34 allows for a slight change of the electron beam emittance, the amount of which can be controlled by an operator to a desired value.

As further shown in FIG. 1, a shaping electrode 38 is included in field electron generator unit 10 and is positioned downstream from ECE 34 to focus and re-shape the electron beam as it passes through an aperture 40 formed therein. According to an exemplary embodiment, shaping electrode 38 is separated from ECE 34 by a spacer element 42 to provide a distance therebetween (e.g., 5-15 mm) that allows for optimized focusing of electron beam 28. The shaping electrode 38 is energized by a voltage controller 44 that is separate from the controllers that energize the ECE 34 and extraction electrode 20 (i.e., controllers 21, 54). In operation, when voltage is provided to shaping electrode 38 from controller 44, an electrostatic field is generated across aperture 40. The electrostatic field interacts with electron beam 28 such that electrons in electron beam 28 are focused and a cross-section of the electron beam is reshaped. According to an exemplary embodiment, the amount of voltage applied to the shaping electrode 38 is controlled by controller 44 so as to vary a strength of the electrostatic field, thereby controlling the focusing and reshaping of the electron beam 28.

The electron beam 28 is focused/reshaped by the electrostatic force generated by shaping electrode 38 such that the electron beam 28 forms a desired focal spot 46 (i.e., a focal spot having a desired aspect ratio) on a target anode 48 that positioned inside a vacuum chamber 47 along with electron generator unit 10 formed by a housing or envelope 49. As shown in FIG. 1, target anode 48 is in the form of a tilted, stationary target that is surrounded by a target shield 50. The target shield 50 provides for capture of secondary electron beams and ions generated from the target anode 48 when the primary electron beam impinges thereon, as well as provides improved high voltage stability. According to an exemplary embodiment, the target anode 48 is tilted by around 7-70 degrees with respect to electron beam 28. Impinging of electrons on anode target 48 generates x-rays that exit from a viewing window 52 behind the target anode 48. A detector (not shown) views the x-ray from a shallow angle (7 degree) with respect to the surface of the target anode 48. While target anode 48 is shown as a tilted, stationary target, it is recognized that the target anode could also be in the form of a rotating target for high power applications.

Figure 3:
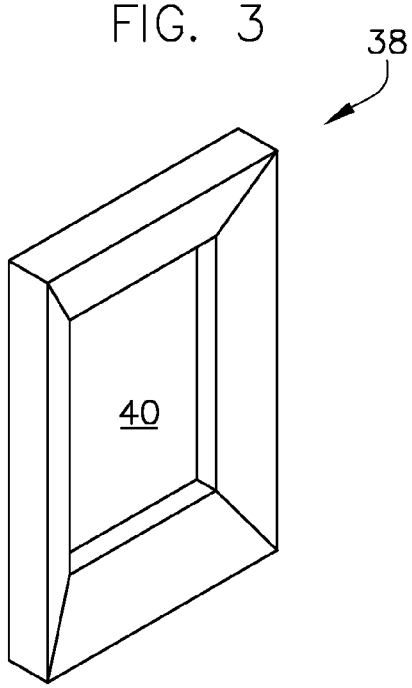
FIG. 3 is a perspective view of a shaping electrode for use in the electron emitter unit of FIG. 1 in accordance with an embodiment of the present invention.
Figure 4:
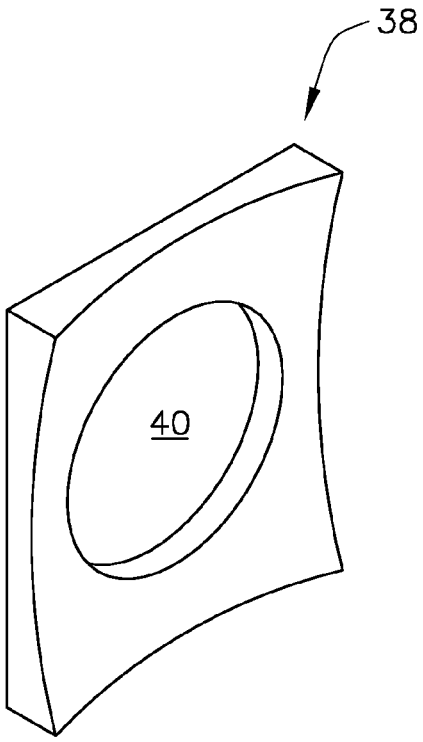
FIG. 4 is a perspective view of a shaping electrode for use in the electron emitter unit of FIG. 1 in accordance with an embodiment of the present invention.

According to embodiments of the invention, the aperture 40 formed through shaping electrode 38 is non-circular in shape. The non-circular aperture 40 in shaping electrode 38 acts to reshape the circular electron beam as it passes therethrough, so as to form a non-circular electron beam having a desired aspect ratio and provide for formation of a non-circular focal spot 46 (i.e., linear focal spot) on target anode 48. As shown in FIGS. 3 and 4, aperture 40 can be any of a variety of non-circular shapes, so as to focus and shape electron beam 28 to have a desired aspect ratio. For example, aperture 40 can be in the form of a rectangular (FIG. 3) or elliptical (FIG. 4) shape. As further shown in each of FIGS. 3 and 4, the aperture 40 is formed as a conical opening to provide further improved focusing of electron beam 28. That is, shaping electrode 38 is formed to have an angled surface that extends outward and upward from aperture 40. As shown in FIG. 3, shaping electrode 38 is angled outward and upward from rectangular aperture 40 in four separate directions, with the portions of the shaping electrode 38 surrounding the rectangular aperture 40 having identical slopes or varying slopes. As shown in FIG. 4, shaping electrode 38 is angled outward and upward from elliptical aperture 40 in a smooth transition between the aperture and a perimeter of the shaping electrode.

Figure 5:
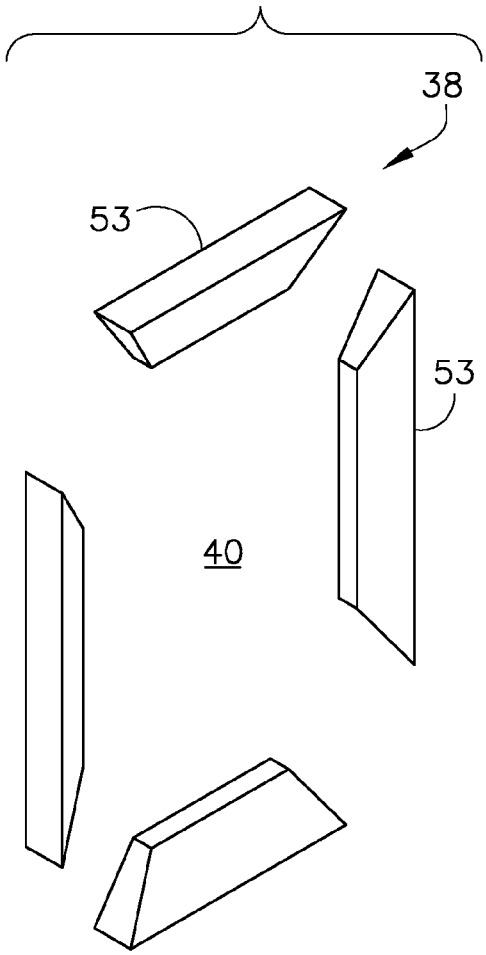
FIG. 5 is a perspective view of a shaping electrode for use in the electron emitter unit of FIG. 1 in accordance with an embodiment of the present invention.

Referring now to FIG. 5, according to another embodiment of the invention, shaping electrode 38 is constructed to have a multi-piece construction and is formed of four electrode pieces 53. The four electrode pieces 53 are shaped and arranged so as to define a rectangular shaped aperture 40 (i.e., non-circular aperture) that provides for reshaping of the circular electron beam as it passes therethrough, so as to form a non-circular electron beam having a desired aspect ratio and provide for formation of a non-circular focal spot 46 (i.e., linear focal spot) on target anode 48 (FIG. 1). Additionally, by supplying varied voltages to electrode pieces 53 (e.g., from controller 44), shaping electrode 38 can act to deflect electron beam 28 a desired amount, thereby providing for wobbling of the electron beam, as might be desired for use with a rotating target anode.

Figure 6:
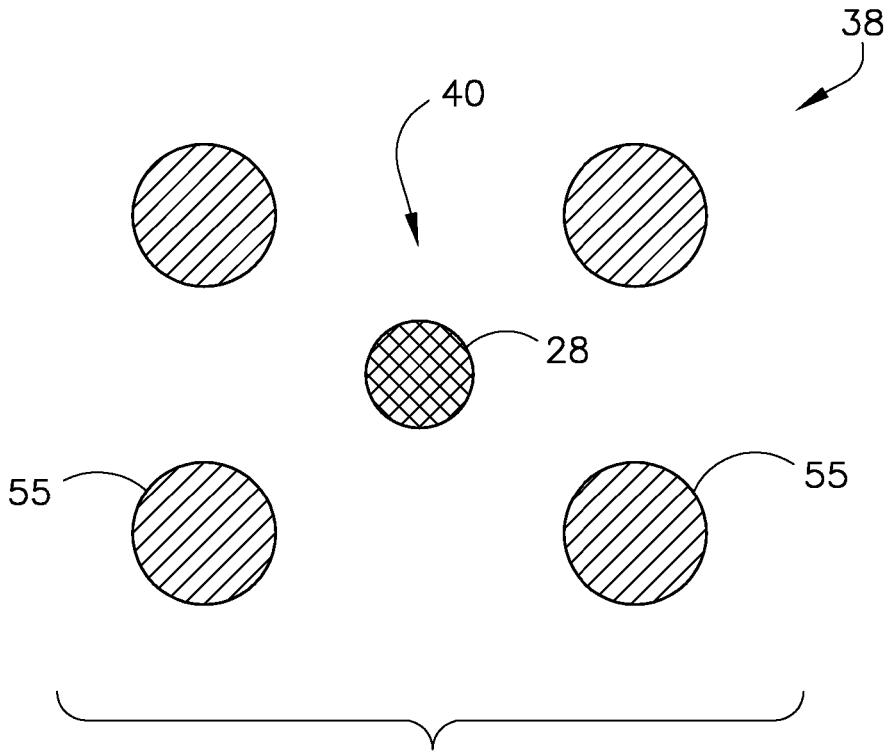
FIG. 6 is a cross-sectional view of a shaping electrode for use in the electron emitter unit of FIG. 1 in accordance with an embodiment of the present invention.

Referring now to FIG. 6, according to another embodiment of the invention, shaping electrode 38 is constructed to have an electrostatic quadrupole construction formed of four electrode members 55. The four electrode members are arranged to have alternating polarities and are positioned so as to generally define a rectangular shaped aperture 40 (i.e., non-circular aperture) that provides for reshaping of the circular electron beam as it passes therethrough, so as to form a non-circular electron beam having a desired aspect ratio and provide for formation of a non-circular focal spot 46 (i.e., linear focal spot) on target anode 48 (FIG. 1). It is also recognized that a dipole voltage can be added onto electrode members 55 to deflect the electron beam 28 in desired directions.

While electron generator unit 10 is shown and described in FIGS. 1 and 2 as including a circular emitter element 26 that emits an electron beam 28 having a circular profile, it is recognized that the electron generator unit 10 can instead include an emitter element 26 that is non-circular in shape (i.e., a non-circular aspect ratio). That is, according to additional embodiments of the invention, focusing electrode 38 (such as shown in FIGS. 3-6) can shape and focus an electron beam 28 emitted from a non-circular emitter element 26 that has a first aspect ratio (non-circular or circular) such that the beam is modified from a first aspect ratio to a second aspect ratio that is different from the first aspect ratio, and such that a second aspect ratio focal spot 46 can be formed on target anode 48 having a desired size and shape. Thus, embodiments of the invention are not meant to be limited to an electron generator unit 10 having a circular emitter element 26, but include electron generator units incorporating an emitter element having any aspect ratio shape and employ a shaping electrode with a non-circular aperture to reshape/focus the electron beam to another desired aspect ratio shape.

Figure 7:
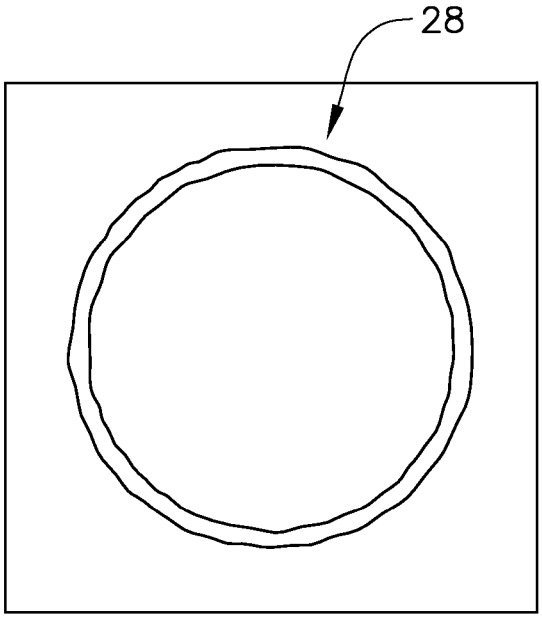
FIG. 7 is a cross-sectional view of an electron beam generated by the circular emitter element of FIG. 2.
Figure 8:
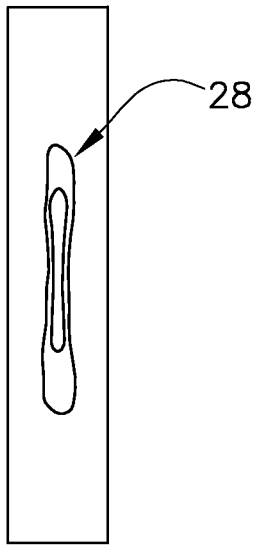
FIG. 8 is a cross-sectional view of an electron beam after reshaping by the shaping electrode.

Referring now to FIGS. 7 and 8, profiles of the electron beam 28 prior and subsequent to focusing and reshaping by shaping electrode 38 are shown according to an embodiment of the invention. As shown in FIG. 7, electron beam 28 has a circular profile/cross-section. According to an exemplary embodiment of the invention, the electron beam 28 maintains a circular profile up until it passes through aperture 40 of shaping electrode 38, such as those shown in FIGS. 3-6. That is, electron beam 28 is generated to have a circular profile by circular emitter element 26, passes through a circular opening 24 of extraction electrode 20, and passes through a circular opening 36 of ECE 34, such that the circular profile of the electron beam 28 is maintained (as shown in FIGS. 1 and 2). As shown in FIG. 8, electron beam 28 is reshaped to have a non-circular or "linear" profile. The non-circular profile of aperture 40 formed through shaping electrode 38, such as those shown in FIGS. 3-6, and the electrostatic filed generated across the aperture 40, act to focus the electron beam 28 and reshape it from a circular profile to a non-circular profile, such that a focal spot 46 (FIG. 1) having a desired size and aspect ratio is formed on target anode 48 (FIG. 1).

Figure 9:
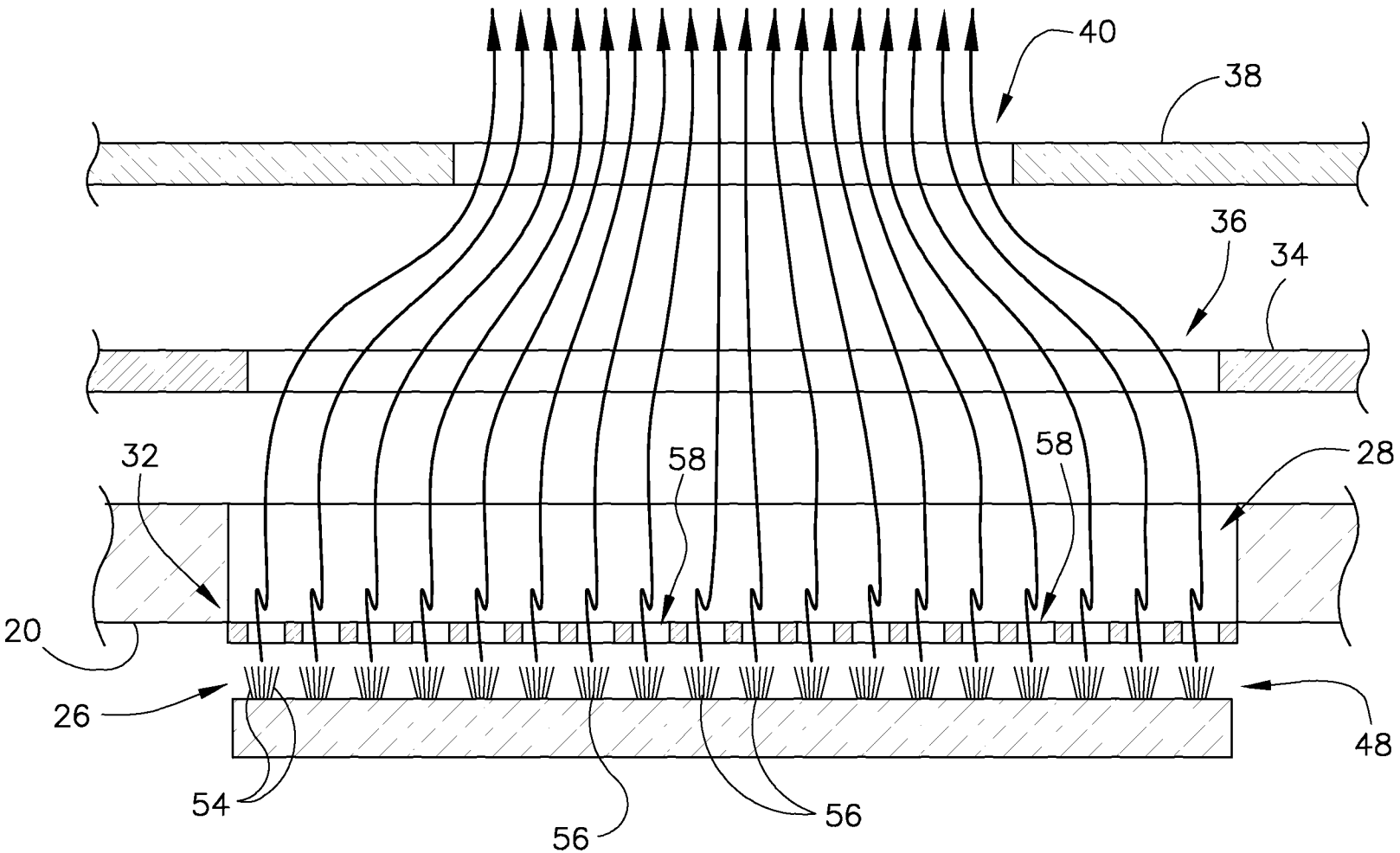
FIG. 9 is a partial cross-sectional view of a field emitter element for use with the electron emitter unit of FIG. 1 in accordance with an embodiment of the present invention.

Referring now to FIG. 9, according to an exemplary embodiment, emitter element 26 is formed of a plurality of carbon nanotubes (CNTs) 54, which are arranged to form an emitter element having a circular profile (such as shown in FIG. 2). To reduce the attenuation of electron beam 28 caused by the striking of electrons against meshed grid 32, CNTs 54 are patterned into multiple CNT groups 56 that are aligned with openings 58 in the grid. By aligning CNT groups 56 with openings 58 in meshed grid 32, interception of beam current in electron beam 28 can be reduced to almost zero, depending on the grid structures. Also, by aligning CNT groups 56 with openings 58, a substantially higher fraction of electrons will pass through the grid 32, thus increasing the total beam emission current and allowing for optimal focusing of electron beam 28 for forming a desired focal spot.

As further shown in FIG. 9, electron beam 28 is generated to maintain a circular profile as it passes through meshed grid 32 positioned in aperture 24 of extraction electrode 20 and as it passes through aperture 36 of ECE 34. Upon reaching shaping electrode 38, electron beam 28 is caused to pass through non-circular aperture 40 of the shaping electrode 38 and is acted upon by the electrostatic filed generated across the non-circular aperture. Electron beam 28 is focused and reshaped by shaping electrode 38 such that it exits the shaping electrode 38 having a non-circular profile that will form a linear focal spot 46 on target anode 48 (FIG. 1) having a desired aspect ratio.

Figure 10:
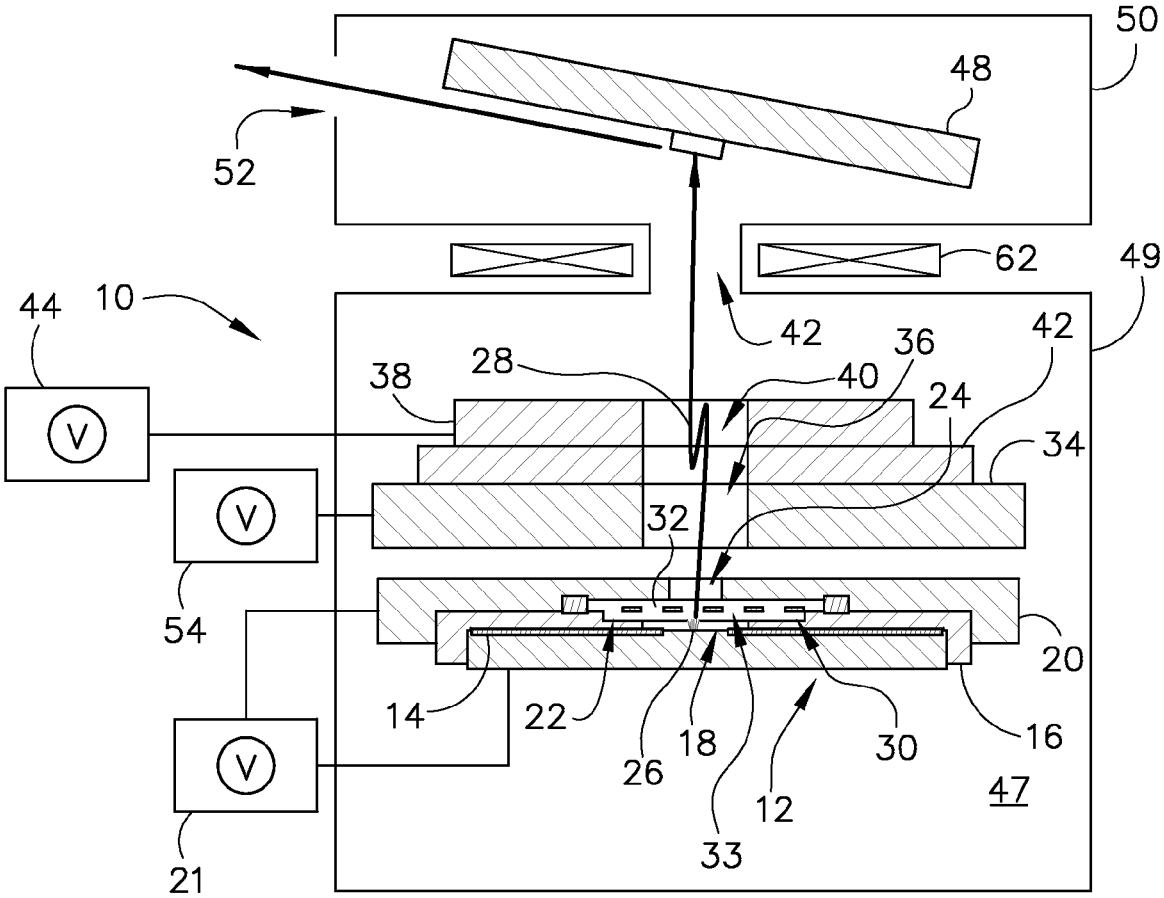
FIG. 10 is a cross-sectional view of an electron generator unit and target anode in accordance with another embodiment of the present invention.

Referring now to FIG. 10, a cross-sectional view of an electron generator unit 60 is depicted according to another embodiment of the invention. Electron generator unit 60 has a structure identical to that of electron generator unit 10 shown in FIG. 1, but additionally includes therein one or more magnetic quadrupole members and/or one or more magnetic dipole members 62 configured to provide additional electron beam focusing, shaping, and/or deflection (e.g., for wobbling of the electron beam). As shown in FIG. 7, a single magnetic quadrupole member 62 is included in electron generator unit 60, although it is recognized that a greater number of magnetic quadrupole and dipole members could be implemented, such as three for example. Quadrupole and/or dipole member 62 is positioned outside of vacuum chamber 47 defined by housing 49 and is positioned downstream of the shaping electrode 38 such that, upon focusing/reshaping of electron beam 28 provided by shaping electrode 38, additional focusing, shaping, and/or deflection of the electron beam can be applied by magnetic quadrupole member 62 to modify the non-circular electron beam 28 output from shaping electrode 38 such that it has a desired size and aspect ratio and position.

Figure 11:
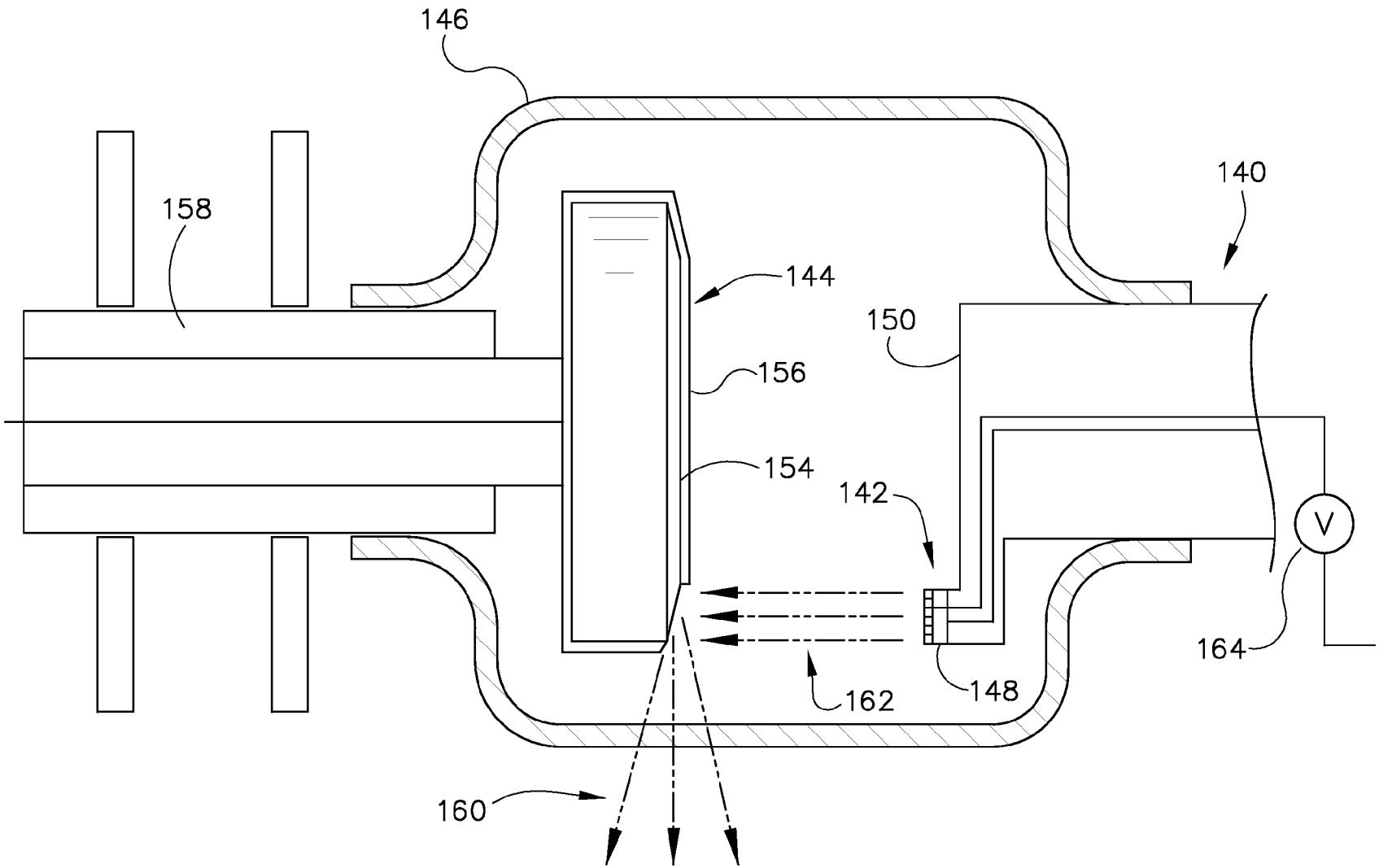
FIGS. 11 and 12 are schematic views of an x-ray tube according to embodiments of the present invention.
Figure 12:
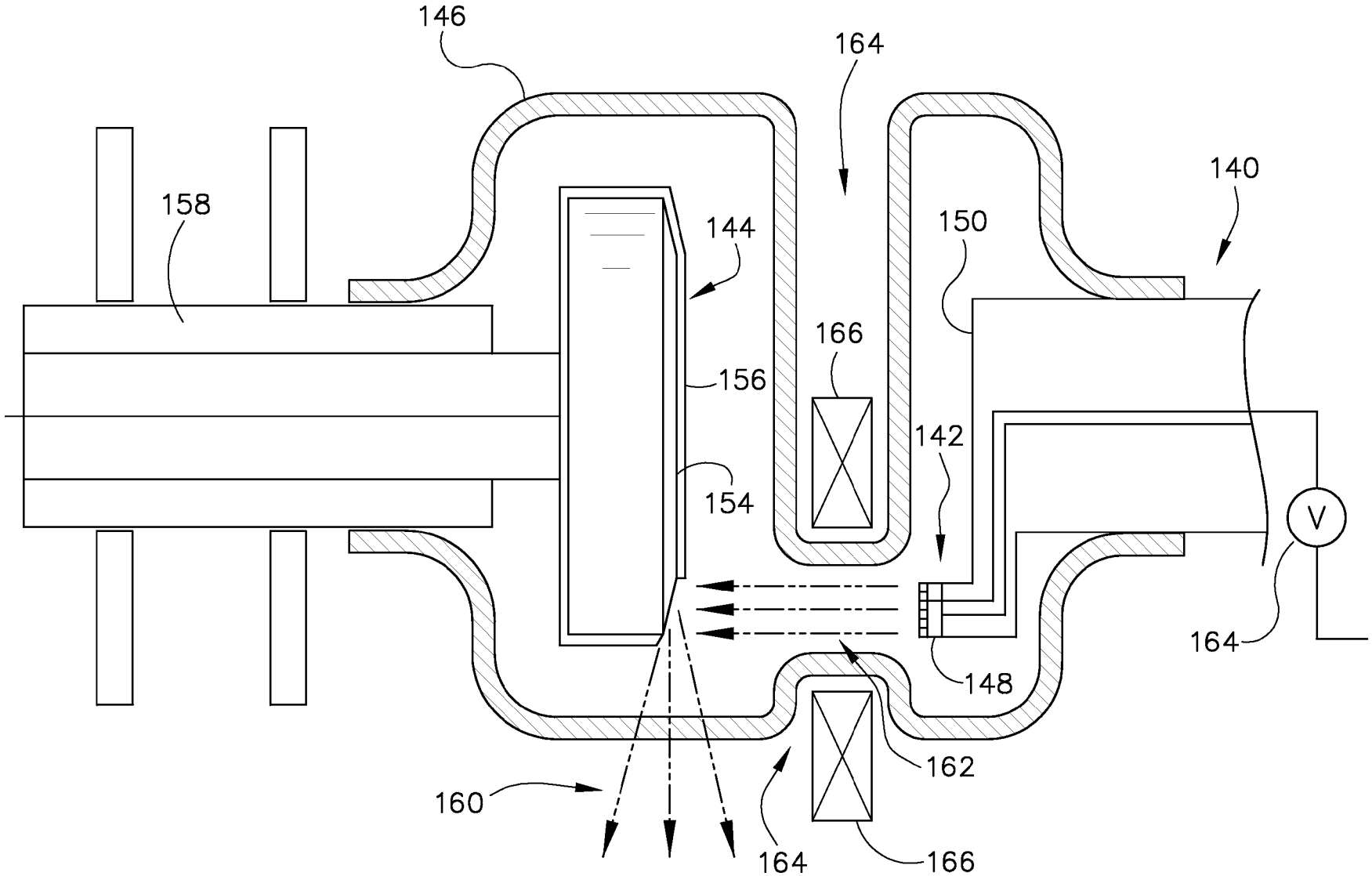

Referring now to FIGS. 11 and 12, an x-ray generating tube 140, such as for use with a CT system, is shown according to embodiments of the invention. Principally, x-ray tube 140 includes a cathode assembly 142 and an anode assembly 144 encased in a housing 146, with cathode assembly 142 being constructed in accordance with the electron generator unit 10 shown and described in FIG. 1, and specifically including a shaping electrode 38 having a non-circular aperture (FIGS. 3-6). As shown in FIGS. 11 and 12, anode assembly 144 includes a rotor 158 configured to turn a rotating anode disc 154, and an anode shield 156 surrounding the anode disc, as is known in the art. When struck by an electron current 162 from cathode assembly 142, anode 156 emits an x-ray beam 160 therefrom. Cathode assembly 142 incorporates an electron source 148 positioned in place by a support structure 150. According to an exemplary embodiment, electron source 148 is in the form of a CNT FE unit that produces the primary electron current 162. According to the embodiment of FIG. 11, housing 146 of x-ray tube 140 is formed having a generally uniform circumference along an entire length thereof and defining a vacuum about cathode assembly 142 and anode 156. According to the embodiment of FIG. 12, housing 146 of x-ray tube 140 is formed to include a neck 164 between cathode assembly 142 and anode 156 through which electron current 162 passes, such that one or more magnetic quadrupole or dipole members 166 can be implemented outside the housing 146 to shape, focus and deflect electron current 162.

Figure 13:
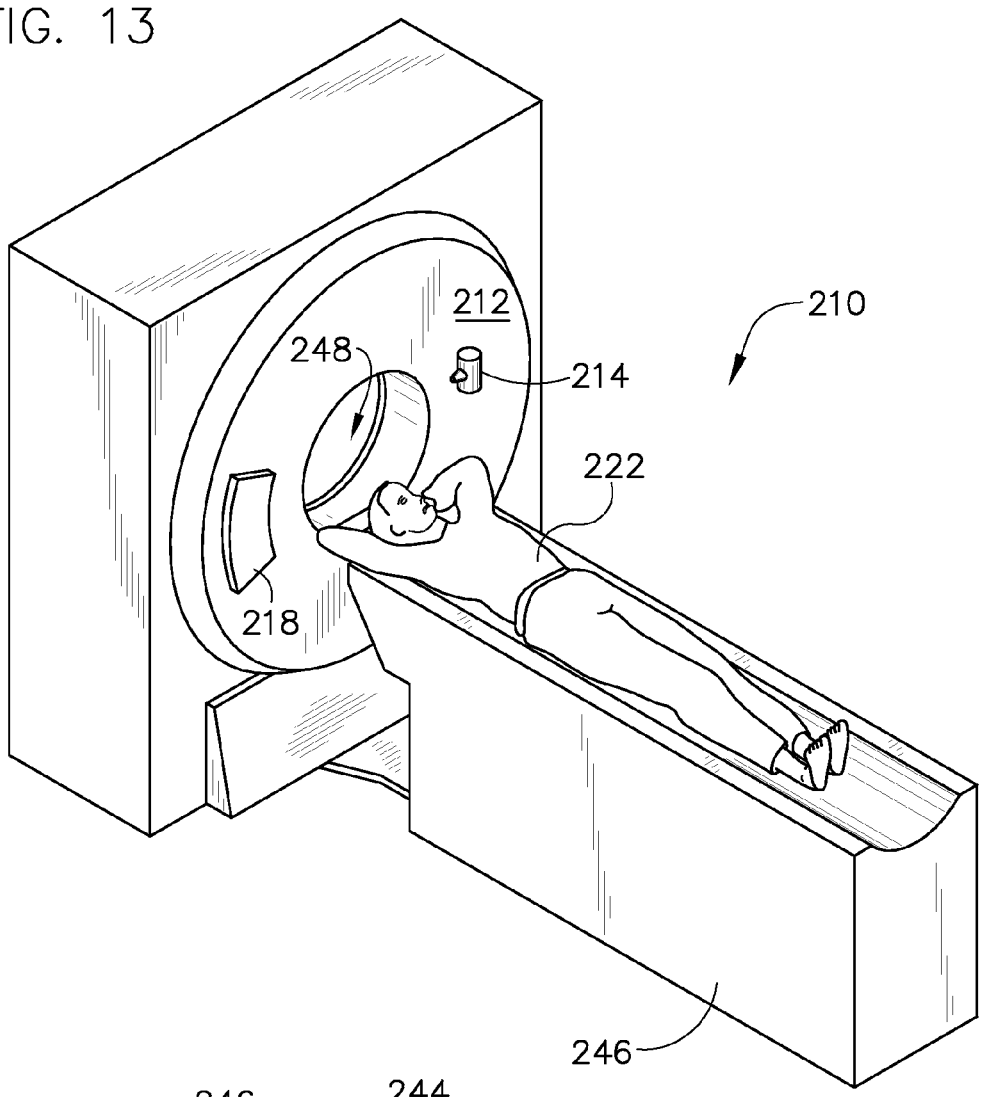
FIG. 13 is a perspective view of a CT imaging system incorporating an embodiment of the present invention.
Figure 14:
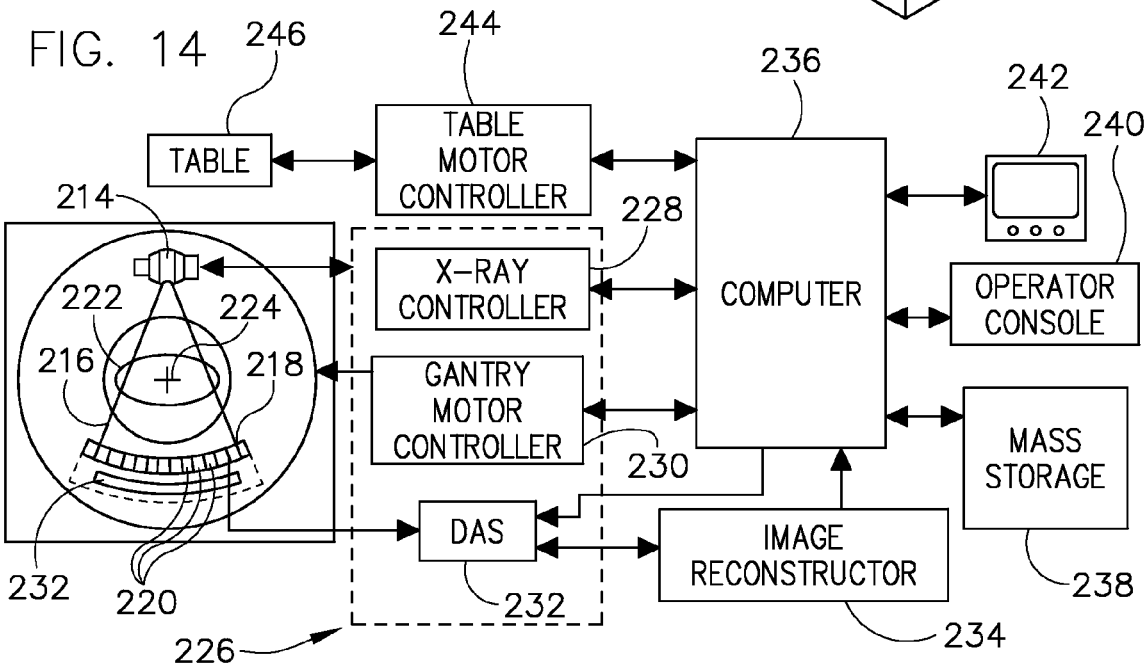
FIG. 14 is a schematic block diagram of the system illustrated in FIG. 13.

Referring to FIG. 13, a computed tomography (CT) imaging system 210 is shown as including a gantry 212 representative of a "third generation" CT scanner. Gantry 212 has an x-ray source 214 that rotates thereabout and that projects a beam of x-rays 216 toward a detector assembly or collimator 218 on the opposite side of the gantry 212. X-ray source 214 includes an x-ray tube having an electron generator constructed as in accordance with that shown in FIGS. 1-6. Referring now to FIG. 14, detector assembly 218 is formed by a plurality of detectors 220 and data acquisition systems (DAS) 232. The plurality of detectors 220 sense the projected x-rays that pass through a medical patient 222, and DAS 232 converts the data to digital signals for subsequent processing. Each detector 220 produces an analog electrical signal that represents the intensity of an impinging x-ray beam and hence the attenuated beam as it passes through the patient 222. During a scan to acquire x-ray projection data, gantry 212 and the components mounted thereon rotate about a center of rotation 224.

Rotation of gantry 212 and the operation of x-ray source 214 are governed by a control mechanism 226 of CT system 210. Control mechanism 226 includes an x-ray controller 228 that provides power, control, and timing signals to x-ray source 214 and a gantry motor controller 230 that controls the rotational speed and position of gantry 12. X-ray controller 228 is preferably programmed to account for the electron beam amplification properties of an x-ray tube of the invention when determining a voltage to apply to field emitter based x-ray source 214 to produce a desired x-ray beam intensity and timing. An image reconstructor 234 receives sampled and digitized x-ray data from DAS 232 and performs high speed reconstruction. The reconstructed image is applied as an input to a computer 236 which stores the image in a mass storage device 238.

Computer 236 also receives commands and scanning parameters from an operator via console 240 that has some form of operator interface, such as a keyboard, mouse, voice activated controller, or any other suitable input apparatus. An associated display 242 allows the operator to observe the reconstructed image and other data from computer 236. The operator supplied commands and parameters are used by computer 236 to provide control signals and information to DAS 232, x-ray controller 228 and gantry motor controller 230. In addition, computer 236 operates a table motor controller 244 which controls a motorized table 246 to position patient 222 and gantry 212. Particularly, table 246 moves patients 222 through a gantry opening 248 of FIG. 13 in whole or in part.

While described with respect to a sixty-four-slice "third generation" computed tomography (CT) system, it will be appreciated by those skilled in the art that embodiments of the invention are equally applicable for use with other imaging modalities, such as electron gun based systems, x-ray projection imaging, package inspection systems, as well as other multi-slice CT configurations or systems or inverse geometry CT (IGCT) systems. Moreover, the invention has been described with respect to the generation, detection and/or conversion of x-rays. However, one skilled in the art will further appreciate that the invention is also applicable for the generation, detection, and/or conversion of other high frequency electromagnetic energy.

Therefore, according to one embodiment of the invention, an electron generator unit includes an emitter element configured to generate an electron beam having a first aspect ratio shape and an extraction electrode positioned adjacent to the emitter element to extract the electron beam out therefrom, the extraction electrode including an opening therethrough. The electron generator unit also includes at least one shaping electrode positioned to receive the electron beam after passing through the extraction electrode, the shaping electrode defining a non-circular aperture therein and being configured to provide at least one of shaping and focusing of the electron beam to have a second aspect ratio shape different from the first aspect ratio shape so as to form a focal spot having a desired size and aspect ratio on a target anode.

According to another embodiment of the invention, an x-ray tube includes a housing enclosing a vacuum chamber and an electron generator unit positioned within the housing, with the electron generator unit further including an emitter element configured to generate an electron beam having a first aspect ratio, an extraction electrode having an opening therethrough that is positioned adjacent to the emitter element to extract the electron beam out therefrom, and at least one shaping electrode positioned to receive the electron beam after passing through the extraction electrode, with the shaping electrode defining a non-circular opening therein and being configured to shape the electron beam to have a second aspect ratio different from the first aspect ratio. The x-ray tube also includes a target anode positioned in a path of the shaped electron beam and configured to emit high-frequency electromagnetic energy when the shaped electron beam impinges thereon.

According to yet another embodiment of the invention, an x-ray tube includes a circular emitter element configured to generate an electron beam having a circular cross-section and a shaping electrode positioned to receive the electron beam from the circular emitter element and having a non-circular aperture formed therethrough, the non-circular aperture of the shaping electrode configured to focus and shape the electron beam as it passes through the shaping electrode such that a shape of the electron beam is modified to have a non-circular cross-section. The x-ray tube also includes a target anode positioned in a path of the non-circular electron beam that is configured to emit high-frequency electromagnetic energy when the non-circular electron beam impinges thereon.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An electron generator unit comprising:

an emitter element configured to generate an electron beam having a first aspect ratio shape;

an extraction electrode positioned adjacent to the emitter element to extract the electron beam out therefrom, the extraction electrode including an opening therethrough in which a meshed grid is positioned;

at least one shaping electrode positioned to receive the electron beam after passing through the extraction electrode, the shaping electrode defining a non-circular aperture therein and being configured to provide at least one of shaping and focusing of the electron beam to have a second aspect ratio shape different from the first aspect ratio shape so as to form a focal spot having a desired size and aspect ratio on a target anode;

an emittance compensation electrode (ECE) positioned between the extraction electrode and the shaping electrode and configured to control emittance growth of the electron beam, such that electrons in the electron beam are compressed along a direction of travel of the electron beam and caused to have nearly the same momentum; and a controller configured to:

cause a voltage to be applied to the extraction electrode to generate a desired current density in the electron beam;

determine a voltage to be applied to the ECE that minimizes emittance growth of the electron beam based on the voltage applied to the extraction electrode; and cause the determined voltage to be applied to the ECE such that electric fields present at opposing sides of the meshed grid are equal;

wherein, in applying the determined voltage to the ECE, the spread of electrons in the electron beam along the direction of travel of the electron beam is controlled so as to minimize emittance growth.

2. The electron generator unit of claim 1 wherein the at least one shaping electrode comprising a unitary structure, and wherein the non-circular aperture comprises an angled opening formed in the unitary structure.

3. The electron generator unit of claim 2 wherein the non-circular aperture comprises an elliptical aperture.

4. The electron generator unit of claim 2 wherein the non-circular aperture comprises a rectangular aperture.

5. The electron generator unit of claim 1 wherein the meshed grid reduces a voltage needed to extract the electron beam from the emitter element, the meshed grid having a plurality of openings therein.

6. The electron generator unit of claim 5 wherein the emitter element comprises a carbon nano-tube (CNT) field emitter including a plurality of CNT groups, and wherein each of the plurality of CNT groups is aligned with a respective opening in the meshed grid.

7. The electron generator unit of claim 1 wherein the emitter element comprises a circular emitter element configured to generate a circular electron beam; and wherein the at least one shaping electrode is configured to reshape the circular electron beam into a non-circular electron beam.

8. The electron generator unit of claim 1 wherein the controller is further configured to control a voltage applied to the at least one shaping electrode to vary a strength of the electrostatic field, thereby controlling the focusing and reshaping of the electron beam.

9. The electron generator unit of claim 8 wherein the at least one shaping electrode comprises a multi-piece electrode constructed to define the non-circular aperture, and wherein each piece of the multi-piece electrode receives an individually controllable voltage from the controller.

10. The electron generator unit of claim 1 wherein the emitter element comprises a one of a carbon nano-tube (CNT) field emitter and a thermionic cathode.

11. The electron generator unit of claim 1 further comprising at least one of a magnetic quadrupole member and a magnetic dipole member positioned to receive the electron beam after passing through the at least one shaping electrode, the at least one of the magnetic quadrupole member and the magnetic dipole member configured to provide at least one of focusing, shaping, and deflection of the electron beam to form a non-circular focal spot on the target anode having a desired size, aspect ratio, and position.

12. An x-ray tube comprising:

a housing enclosing a vacuum chamber;

an electron generator unit positioned within the housing, the electron generator unit comprising:

an emitter element configured to generate an electron beam having a first aspect ratio;

an extraction electrode positioned adjacent to the emitter element to extract the electron beam out therefrom, the extraction electrode including an opening therethrough in which a meshed grid is positioned;

an emittance compensation electrode (ECE) positioned downstream from the extraction element and configured to compress the electron beam in space and momentum phase space; and at least one shaping electrode positioned to receive the electron beam after passing through the extraction electrode, the shaping electrode defining a non-circular opening therein and being configured to shape the electron beam to have a second aspect ratio different from the first aspect ratio; and a target anode positioned in a path of the shaped electron beam and configured to emit high-frequency electromagnetic energy when the shaped electron beam impinges thereon; and a controller configured to:

cause a voltage to be applied to the extraction electrode to generate a desired current density in the electron beam;

determine a voltage to be applied to the ECE that minimizes emittance growth of the electron beam based on the voltage applied to the extraction electrode; and cause the determined voltage to be applied to the ECE such that electric fields present at opposing sides of the meshed grid are equal;

wherein, in applying the determined voltage to the ECE, the spread of electrons in the electron beam along the direction of travel of the electron beam is controlled so as to minimize emittance growth.

13. The x-ray tube of claim 12 wherein the non-circular opening formed through the focusing element comprises an angled opening having one of an elliptical shape and a rectangular shape.

14. The x-ray tube of claim 12 wherein the controller is further configured to supply a controlled voltage to the shaping electrode, thereby causing the shaping electrode to generate an electrostatic field.

15. The x-ray tube of claim 14 wherein the shaping electrode is configured to focus and shape the circular stream of electrons to form a linear focal spot on a target anode without bending the stream of electrons.

16. An x-ray tube comprising:

a circular emitter element configured to generate an electron beam having a circular cross-section;

an extraction electrode positioned adjacent to the emitter element to extract the electron beam out therefrom, the extraction electrode including an opening therethrough that includes a meshed grid positioned therein to reduce a voltage needed to extract the electron beam from the emitter element, with the meshed grid having a plurality of openings therein;

a shaping electrode positioned to receive the electron beam from the circular emitter element and having a non-circular aperture formed therethrough, the non-circular aperture of the shaping electrode configured to focus and shape the electron beam as it passes through the shaping electrode such that a shape of the electron beam is modified to have a non-circular cross-section;

an emittance compensation electrode (ECE) positioned between the circular emitter element and the shaping electrode and configured to control electron beam emittance growth by compressing electrons in the beam along the direction of travel of the electron beam;

a target anode positioned in a path of the non-circular electron beam and being configured to emit high-frequency electromagnetic energy when the non-circular electron beam impinges thereon; and a controller configured to apply a variable voltage to the shaping electrode to generate an electrostatic force to control focusing and shaping of the electron beam;

wherein the controller is further configured to:

cause a voltage to be applied to the extraction electrode to generate a desired current density in the electron beam;

determine a voltage to be applied to the ECE that minimizes emittance growth of the electron beam based on the voltage applied to the extraction electrode; and cause the determined voltage to be applied to the ECE such that electric fields present at opposing sides of the meshed grid are equal;

wherein, in applying the determined voltage to the ECE, the spread of electrons in the electron beam along the direction of travel of the electron beam is controlled so as to minimize emittance growth wherein the shaping electrode comprises a plurality of electrode pieces arranged to define the non-circular aperture, and wherein each of the plurality of electrode pieces receives an individually variable voltage from the controller in order to focus and shape the electron beam as it passes through the non-circular aperture.

17. The x-ray tube of claim 16 wherein the shaping electrode is configured to focus and shape the electron beam to have a non-circular cross-section so as to form a linear focal spot on the target anode having a desired aspect ratio.

18. The x-ray tube of claim 16 wherein the non-circular aperture formed through the shaping electrode comprises one of an elliptical aperture and a rectangular aperture.

19. The x-ray tube of claim 16 further comprising at least one of a magnetic quadrupole member and a dipole member positioned to receive the electron beam after passing through the shaping electrode, the at least one of the quadrupole member and the dipole member configured to further focus, shape, or deflect the electron beam to form a focal spot on the target anode having a desired size and aspect ratio.

20. The x-ray tube of claim 16 wherein the shaping electrode comprises a plurality of electrode pieces arranged to define the non-circular aperture, and wherein each of the plurality of electrode pieces receives an individually variable voltage from the controller in order to focus and shape the electron beam as it passes through the non-circular aperture.

* * * * *